US005138941A

United States Patent [19]

Strauss

[11] Patent Number: 5,138,941

[45] Date of Patent: Aug. 18, 1992

[54] WOODEN CRUSHER FOR RECYCLABLE METAL CANS

[76] Inventor: Frederick J. Strauss, A 7508 Hy. I, Juneau, Wis. 53039

[21] Appl. No.: 723,195

[22] Filed: Jun. 28, 1991

[51] Int. Cl.[5] ..... B30B 1/02; B30B 9/32

[52] U.S. Cl. ..... 100/53; 100/283; 100/293; 100/902

[58] Field of Search ..... 100/53, 219, 280, 281, 100/283, 293, 902

[56] References Cited

U.S. PATENT DOCUMENTS

| | | | |
|---|---|---|---|
| 3,969,955 | 7/1976 | Markham | 100/53 X |
| 4,054.064 | 10/1977 | Walker | 100/53 X |
| 4,188,875 | 2/1980 | Fabbri et al. | 100/293 X |
| 4,228,734 | 10/1980 | Parrish | 100/293 X |
| 4,290,354 | 9/1981 | Stevens | 100/283 X |
| 4,291,618 | 9/1981 | Heiser et al. | 100/283 X |
| 4,301,722 | 11/1981 | Balbo et al. | 100/902 X |
| 4,323,009 | 4/1982 | Voigt | 100/902 X |
| 4,459,908 | 7/1984 | Sierk | 100/293 X |
| 4,517,892 | 5/1985 | Meisner | 100/902 X |
| 5,009,155 | 4/1991 | Christianson | 100/293 X |

*Primary Examiner*—Harvey C. Hornsby
*Assistant Examiner*—Stephen F. Gerrity
*Attorney, Agent, or Firm*—Plante, Strauss & Vanderburgh

[57] ABSTRACT

There is disclosed a can crusher formed entirely of wood components that can be easily fabricated by an amateur wood worker. The can crusher has a channel body which, at its upper end, provides a slide for a mechanical wooden ram and, at its lower portion, a crushing station to receive and crush aluminum beverage cans. The front of the crusher is covered with a protective plate which limits access to the slide above the can, thus preventing one, such as a child, from inserting fingers between the can and the ram. The ram is carried on the end of a push rod which is linked to a lever which has its fulcrum at a location, relative to the pivot link between the rod and the lever, which insures that the ram moves over center at the completion of the stroke, thereby withdrawing the ram from the can and preventing jamming of the crushing mechanism.

7 Claims, 6 Drawing Sheets

24
28
26
32
50
51
48
36
56
58
39
40
42
44
46
38
34
54

WOODEN CRUSHER FOR RECYCLABLE METAL CANS

FIELD OF INVENTION

This invention relates to a woodworking project and in particular to a project to make a recyclable can crusher and to the can crusher, itself.

BACKGROUND OF THE INVENTION

Increasing concern over energy consumption and the decreasing availability of land fill sites has resulted in a consumer awareness of the value in recycling products such as the ubiquous aluminum metal beverage can.

Can crushers for compacting these cans are commercially available, usually formed of metal with a open channel member to receive the can and a sliding ram linked to a handle which folds over the crusher in its down position. While suitable for location and use in a utility area, this device lacks the attractive appearance desirable for locating in a kitchen or pantry area. Additionally, construction of a wooden can crusher using conventional wood working tools is a challenging and entertaining project for wood workers.

OBJECTIVES OF THE INVENTION

It is an objective of this invention to provide a wood working project that is challenging yet does not require a high degree of skill, and that produces a useful and attractive product.

It is a further object of this invention to provide a can crusher fabricated of wooden parts suitable for an amateur woodworking project.

It is an additional objective of the invention to provide a can crusher of safe design and operation.

It is also an objective of the invention to provide a can crusher which does not jam.

Other and related objectives will be apparent from the following description of the invention.

BRIEF SUMMARY OF THE INVENTION

This invention comprises a can crusher formed entirely of wood components that can be easily fabricated by an amateur wood worker. The can crusher has a channel body which, at its upper end, provides a slide for a mechanical wooden ram and, at its lower portion, a crushing station to receive and crush aluminum beverage cans. The front of the crusher is covered with a protective plate which limits access to the slide above the can, thus preventing one, such as a child, from inserting fingers between the can and the ram. The ram is carried on the end of a push rod which is linked to a lever which has its fulcrum at a location, relative to the pivot link between the rod and the lever, which insures that the ram moves over center at the completion of the stroke, thereby withdrawing the ram from the can and preventing jamming of the crushing mechanism.

BRIEF DESCRIPTION OF THE DRAWINGS

The invention will be described with reference to the figures of which.

DESCRIPTION OF PREFERRED EMBODIMENT

Figure 1:
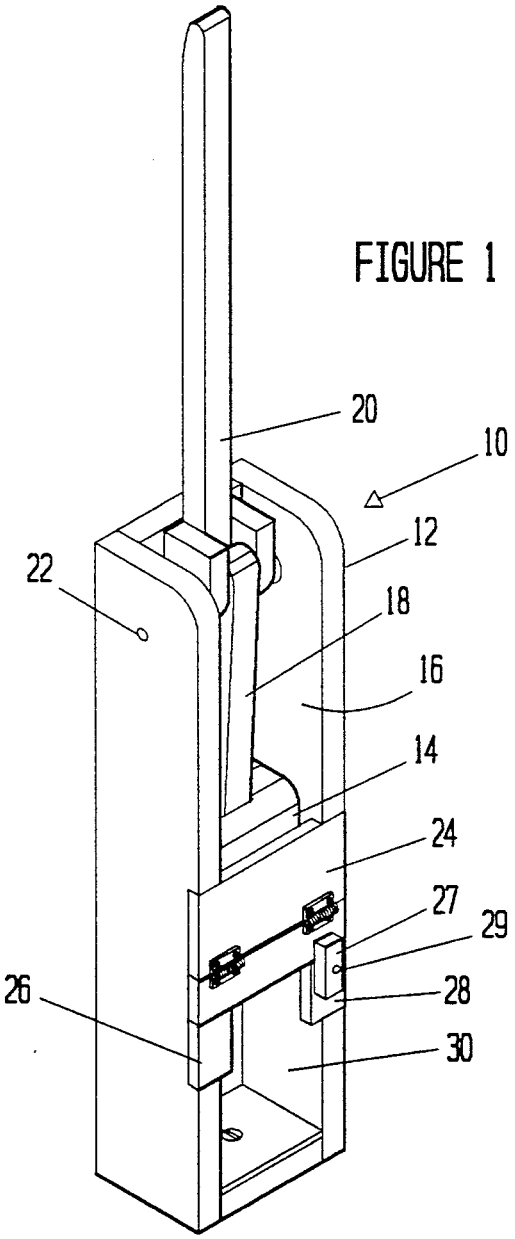
FIG. 1 is a prespective view of the assembled crusher.

Referring to FIG. 1, the assembled can crusher 10 has a channel body 12 which receives a ram block 14 that is slidably housed in the channel 16 of the body 12. The ram block 14 is pivotally supported on the lower end of a link rod 18 which is pivotally attached to the handle 20. The handle 20 has a fulcrum pivotal attachment on pivot pin 22. The front of the body 12 is partially covered with a protective plate 24 which has lower tabs 26 and 28 to define an opening 30 for insertion of a conventionally-sized beverage can. Since beverage cans of 12-ounce and 16-ounce sizes are in common use, the protective plate 24 can be provide with a hinged lower extension 32 that can be raised to provide access of 16-ounce cans to opening 30. The extension can be retained in a closed position by a lock tab in the form of a wooden block pivotally supported on tab 28 with a pin or screw.

Figures 2, 3:
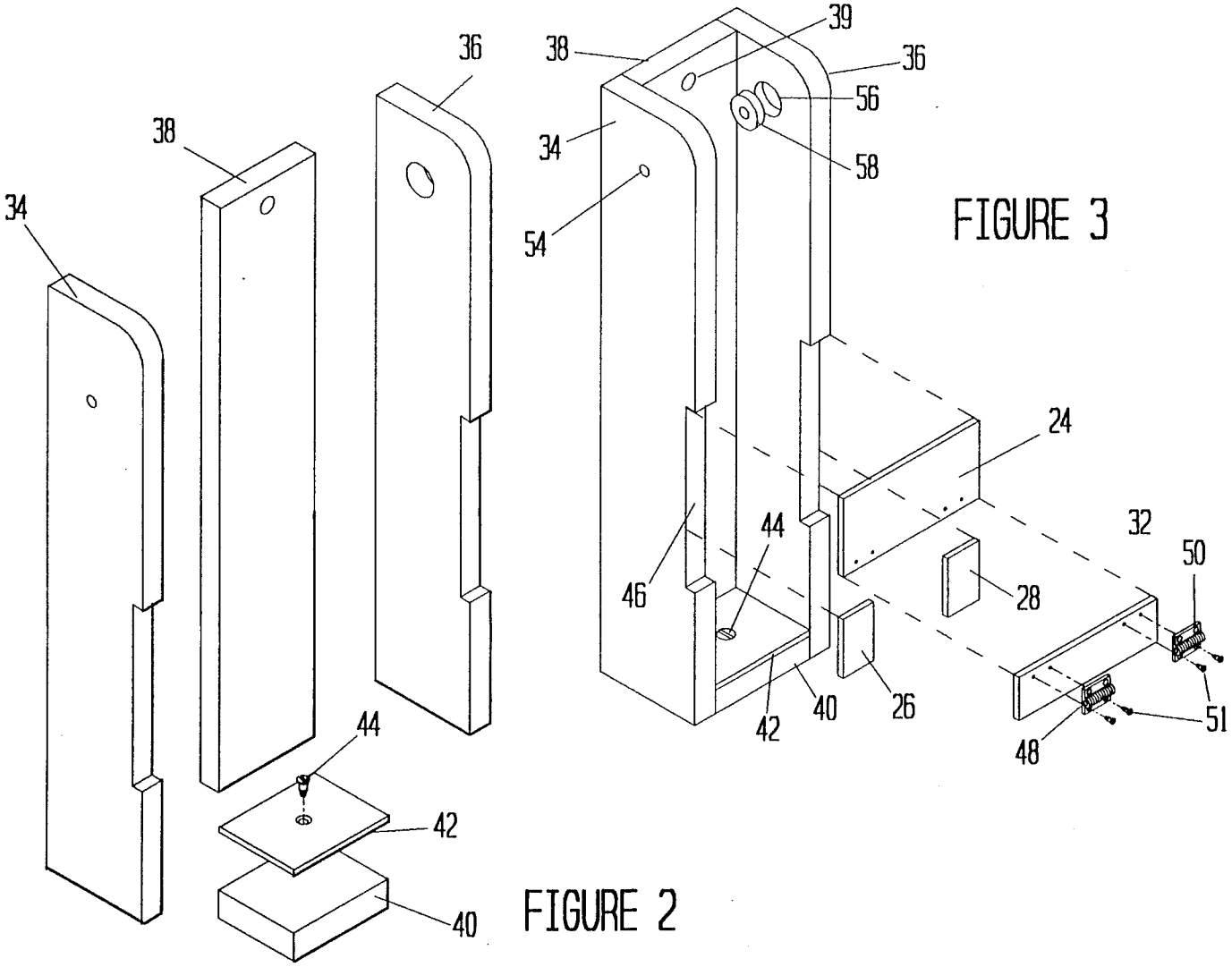
FIG. 2 is an exploded prespective view of the body of the crusher.
FIG. 3 is a prespective view of the body of the crusher, showing the protective plate of the crusher in exploded view.

Referring to FIG. 2, the body 12 of the crusher 10 is formed of right and left sides 34 and 36 which are assembled to a rear plate 38. The components of the crusher are all fabricated of wood or plastic and can be readily fabricated by an amateur woodworker with most hand tools and a bench or radial arm saw. The bottom wall 40 of the body 12 fits within the channel 16 formed by joining of the sides 34 and 36 to the rear plate 38 and, preferably, the bottom wall 40 is covered with a protective plastic plate 42, e.g. high-density polyethylene, polyvinyl chloride, etc. The plastic plate 42 and bottom wall 40 are of the same dimensions and can be secured together by a centrally located assembly screw 44.

The body 12 is glued together and the joints can be strengthened with wooden dowels or, preferably, wood biscuits, using a conventional biscuit joiner. Alternatively, screws or nails could be driven through the sidewalls 34 and 36 into the rear plate 38 and bottom wall 40, however, this would detract from the final appearance of the project. Regardless of the assembly technique, the bottom wall 40 is securely fastened to each of the side walls 34 and 36 and rear plate 38 to provide a very strong construction.

Referring now to FIG. 3, the protective cover plate 24 is illustrated in exploded view. As there illustrated, each of the sidewalls 34 and 36 has a rabbet groove 46 intermediate its height. The length of the rabbet groove 46 and its location are critical, to locate the protective cover plate 24 at the correct height on the side walls 34 and 36 to provides a secure sliding retention of the ram mechanism, described hereinafter, and to prevent one from placing one's fingers between the upper end of the cam and the ram block 14.

In the illustrated embodiment, the crusher 10 is provided with universal acceptance of substantially all aluminum beverage cans currently in use. To this end, the protective cover plate 24 is formed with a lower extension 32 which is attached with a pair of hinges 48 and 50 which are secured by wood screws 51 to the lower edge 52 of the protective cover plate 24, thereby providing sufficient vertical height to the opening to receive 12-ounce beverage cans. Each of the side walls 34 and 36 has a single through aperture 54 located adjacent its upper end. Preferably, each of the through apertures are counterbored at 56 a sufficient distance to permit insertion of a plastic sleeve bearing, such as that shown at 58. The through apertures 54 are in alignment to receive a pivot pin 22 (shown in FIG. 1) which provides the fulcrum axis for the handle 20, as described hereinafter. When the body is formed of hardwoods such as oak, the bearings are optional components as the hardwood itself provides a sufficiently strong and wear-resistant support for the pivot pin 22 of the handle 20.

Figure 4:
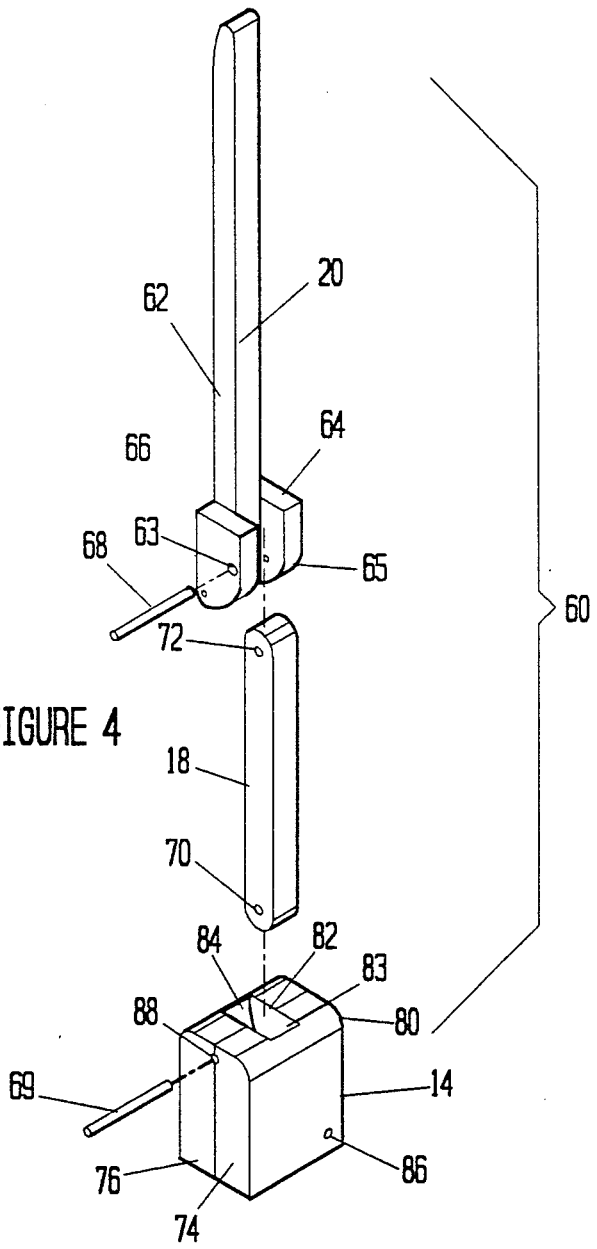
FIG. 4 is an exploded view of the ram and lever mechanism of the invention.

Referring now to FIG. 4, there is illustrated the crushing mechanism 60 in an exploded view. This mechanism 60 includes a handle 20 which is an assembly of a straight bar 62 with a pair of mounting brackets 64 and 66 distally carried on opposite sides of the bar 62. The mounting brackets have arcuate ends and are drilled with through apertures 61 and 63 at precise locations to locate the pivot pin 22 for the handle 20 and to receive the upper pivot pin 68 for the ram block 14 at positions which will cause the ram block 14 to retract from the crushed can at the end of the handle movement, as described hereinafter.

The link rod 18 is a straight wooden rod which has apertures 70 and 72 at its opposite ends to receive the upper pivot pin 68 and the lower pivot pin 69. The ram block 14 is a massive wooden block which is preferably formed by an assembly of first and second mirror halves 74 and 76 to permit use of conventional dimension hardwood lumber and also to provide access for cutting a recess 84 in its upper end 80 to receive the end of the link rod 18. Each half of the ram block 14 is notched centrally, and this can be done with either a table or radial arm saw. When the halves 74 and 76 of the ram block 14 are assembled, the notches 82 and 83 on the halves are opposed so that the joined halves provide a recess 84 to receive the end of the link rod 18. The assembly can be secured with one or more dowels 86, and the aperture 88 for the lower pivot pin 69 is drilled into the upper end of the ram block 14 after its assembly.

Figure 5:
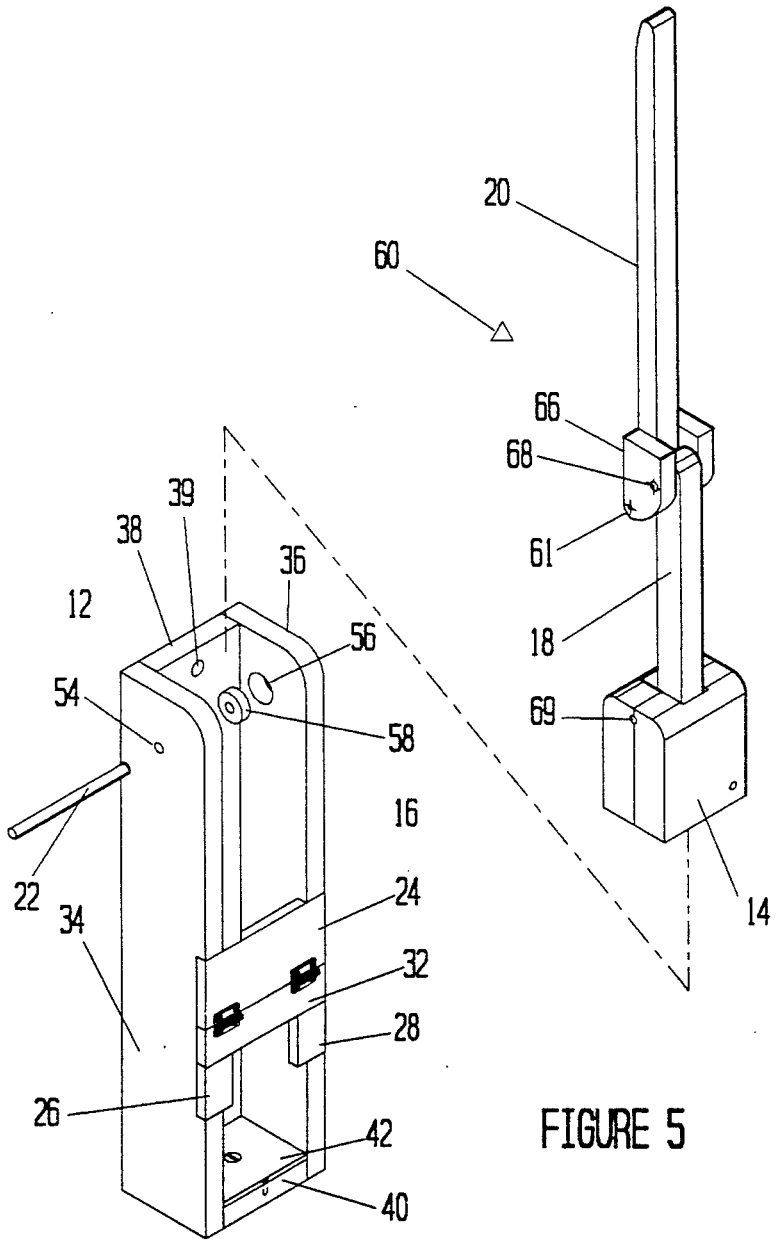
FIG. 5 illustrates the assembly of the ram mechanism to the housing.

The final assembly of the can crusher 10 is shown in FIG. 5. The crushing mechanism 60 is first assembled and then dropped into the channel 16 of the body 12 of the crusher 10, inserting the pivot pin 22 for the handle 20 through the aligned apertures 54 in the sidewalls 34 and 36 and the through aperture 61 in the handle 20. The aligned apertures can be counterbored, as previously mentioned, to receive a bearing 58 of a suitable plastic, e.g., Nylon.

Figure 6:
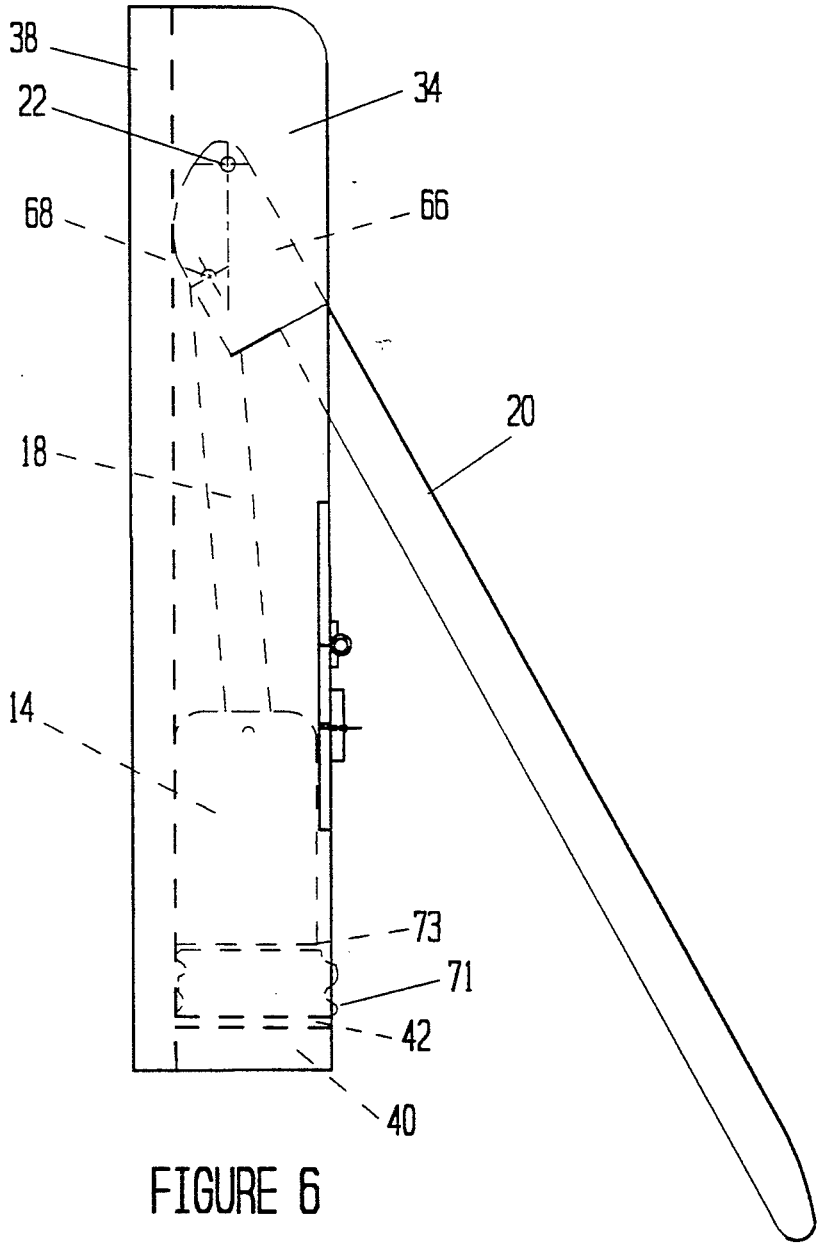
FIG. 6 illustrates the crusher with the handle in its down position.

As shown in FIG. 6, the handle 20 in its down position rotates sufficiently to move the pivot pin 68 between the handle and link rod 18 slightly past center so that the continued downward movement of the handle 20 relieves the pressure on the ram block 14 and retracts the ram block 14 a slight distance 71, freeing the crushed can 73 beneath the ram block 14 and permitting its retraction. This insures that the crushed can does not jam the crushing mechanism.

Figure 7:
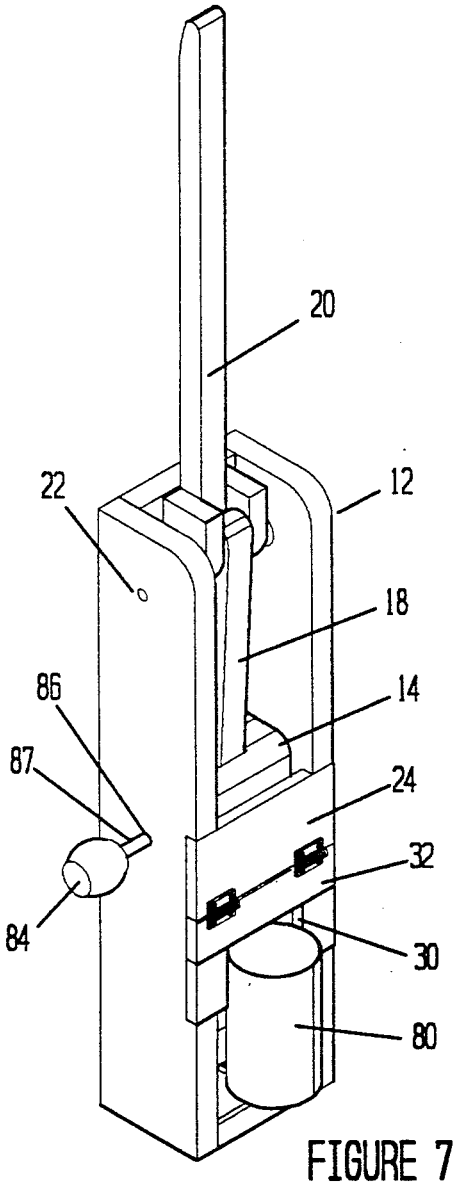
FIGS. 7 and 8 illustrate the crusher for varied sizes of cans.
Figure 8:
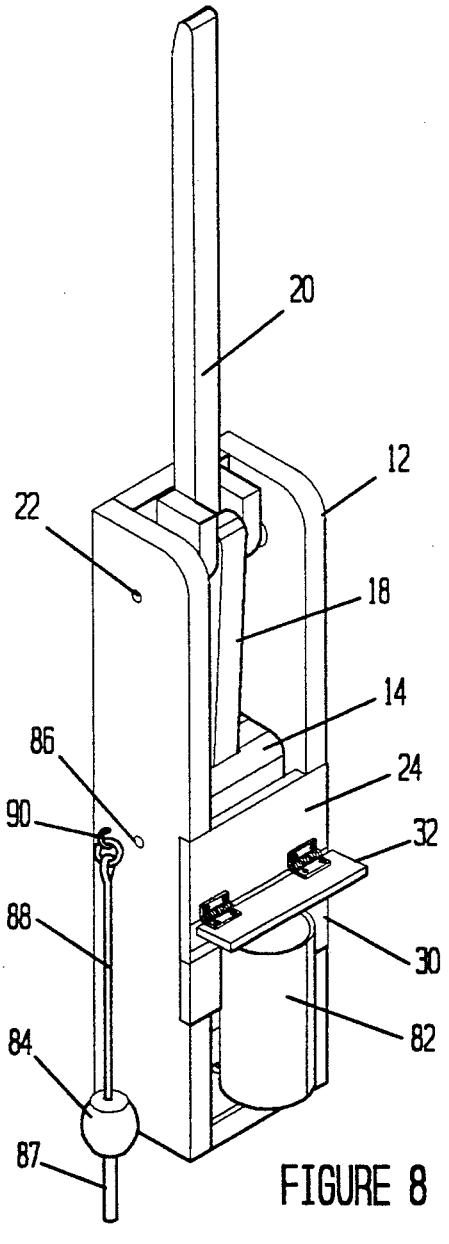

As shown in FIGS. 7 and 8, the protective cover plate 24 on the body 12 protects the ram block 14 from exposure during use and prevents one from inserting one's fingers above the top edge of a conventional 12-ounce beverage can (FIG. 7); or a conventional 16-ounce beverage can (FIG. 8). This also ensures that children will not be injured when playing or using the can crusher. FIGS. 7 and 8 also illustrate an optional element; the wooden plug 88 which has a dowel shaft 87 that can be inserted into a hole 90 drilled through sidewall 34 and into the ram block 14. This permits locking the ram mechanism in its up position, shown in the figures. To avoid loss of the plug, it can be tethered to the body 12 with a cord or chain which is secured with a staple to the sidewall 34.

The invention provides the amateur woodworker with a challenging project which can be readily fabricated using conventional hand tools and either a table or radial arm saw. No special equipment or tools are required, however, a biscuit joiner would be desirable to speed the assembly of the unit.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A crusher for crushing beverage cans which comprises:

a. a housing comprising a channel having upper and lower ends and formed of coextensive back and side plates, and a bottom plate closing the lower end of said channel and with aligned, through fulcrum apertures in said side plates adjacent the upper end of said housing;

b. a ram block slidably received within said channel and having upper and lower ends and a centrally located recess in its upper end intersected by an orthogonal through bore;

c. a lever mounted at the upper end of said housing and having a central handle distally supporting on opposite sides, blocks secured to opposite sides of said lever with the upper edges of said blocks being flush with the upper edge of said handle, thereby forming a slot coextensive the length of said blocks and along the bottom edge of said handle, with a fulcrum bore through said handle which is in alignment with said through fulcrum apertures in said side plates of said housing and receiving a fulcrum pivot shaft through said aligned apertures and fulcrum bore, and a second through bore in said side blocks, transverse to and intersecting said slot and a connecting pin received in said second through bore;

d. a push rod having first and second through bores, one each at each end thereof, with one end of said push rod received in said recess of said ram block with a first connecting pivot pin extending through the aligned orthogonal bore of said ram block and said first through bore of said push rod, and the other end of said push rod received in said slot between said side blocks of said lever with a second connecting pivot pin extending through said aligned through bores of said first and second blocks and said second through bore of said push rod;

e. a front cover enclosing the slide portion of said channel with its bottom edge located above the bottom plate of said channel a distance no greater than the height of a conventional beverage can, whereby when said can is placed beneath said ram, the lower edge of said front cover is adjacent the upper end of said can, thereby preventing insertion of one's fingers into the path of said ram block.

2. The can crusher of claim 1 wherein said front cover is formed of two parts, the first part being fixedly secured to said housing and located a distance above said bottom plate equal to the height of a conventional 16-ounce beverage can, and the second part being hingedly secured to the lower edge of said first part and having a width equal to the difference in heights of conventional 16-ounce and 12-ounce beverage cans.

3. The can crusher of claim 1 wherein said fulcrum bore is located relative to said second through bore intersecting said slot, such that when said lever is moved through a crushing stroke, the ram block is retracted at the completion of the stroke.

4. The can crusher of claim 1 formed entirely of wood.

5. The can crusher of claim 4 including protective and wear resistant plates of plastic on the bottom surface of said ram block and on the upper inside surface of said bottom plate of said housing.

6. The can crusher of claim 5 including bearings received in said aligned through bores in said side plates adjacent the upper end of said housing and receiving said fulcrum pin.

7. The can crusher of claim 6 wherein said bearings are formed of a low friction coefficient plastic.

* * * * *